US007273990B2

(12) United States Patent
Yoshida et al.

(10) Patent No.: US 7,273,990 B2
(45) Date of Patent: Sep. 25, 2007

(54) ICE STORAGE DETECTION SWITCH

(75) Inventors: Kazuhiro Yoshida, Aichi-ken (JP); Hideji Ota, Aichi-ken (JP); Atsushi Sugita, Aichi-ken (JP)

(73) Assignee: Hoshizaki Denki Kabushiki Kaisha, Aichi-ken (JP)

( * ) Notice: Subject to any disclaimer, the term of this patent is extended or adjusted under 35 U.S.C. 154(b) by 181 days.

(21) Appl. No.: 11/270,589

(22) Filed: Nov. 10, 2005

(65) Prior Publication Data

US 2007/0103323 A1 May 10, 2007

(51) Int. Cl.
*H01H 35/00* (2006.01)

(52) U.S. Cl. ..... 200/61; 200/61.41

(58) Field of Classification Search ..... 200/61, 200/61.2, 61.41, 58 R, 61.59, 332, 335; 335/205–207; 62/131, 344; 222/64–66, 58, 590–608
See application file for complete search history.

(56) References Cited

U.S. PATENT DOCUMENTS 4,610,147 A * 9/1986 Kawasumi ..... 62/137
4,662,182 A * 5/1987 Tsukiyama et al. ..... 62/137
5,033,273 A * 7/1991 Buchser et al. ..... 62/344
5,390,504 A * 2/1995 Hida et al. ..... 62/137
5,444,200 A * 8/1995 Ikari ..... 200/61.2

* cited by examiner

*Primary Examiner*—Michael A. FriedHofer
*Assistant Examiner*—Lisa Klaus
(74) *Attorney, Agent, or Firm*—Wenderoth, Lind & Ponack, L.L.P.

(57) ABSTRACT

The present invention provides an ice storage detection switch for detecting an ice level in an ice storage chamber of an ice making machine including: a magnet lever rotatably fitted to the switch lever, for holding the magnet so that the magnet is located in a vicinity of the reed switch when the switch lever is not pressed; and a projecting portion formed on the switch case to be located between a rotational center of the magnet lever and the reed switch, the magnet separating from the reed switch through abutment of the magnet lever on the projecting portion and rotation of the magnet lever when the switch lever is pressed.

3 Claims, 6 Drawing Sheets

ICE STORAGE DETECTION SWITCH

BACKGROUND OF THE INVENTION

1. Field of the Invention

The present invention relates to an ice storage detection switch, and more particularly to a switch for detecting an ice level in an ice storage chamber of an ice making machine.

2. Description of the Related Art

In an ice making machine for storing blocks of ice produced by an ice making portion in an ice storage chamber, an ice storage detection switch as shown in, for example, FIG. 5 is installed in the ice storage chamber. This ice storage detection switch is intended to detect the ice level in the ice storage chamber and stop operation of the ice making machine. In this ice storage detection switch, a switch lever 2 is rotatably fitted about a rotational center 3 on the ice storage chamber side of a switch case 1 fixed to a wall surface or the like of the ice making chamber (e.g., see Japanese Utility Model Application Laid-open No. 1-151177).

As shown in FIG. 6*a*, in the switch case 1, a reed switch 5 is embedded in a reed switch holding portion 4 formed protrusively toward the switch lever 2. On the other hand, a magnet lever 6 is rotatably fitted to a back surface of the switch lever 2, and a magnet 7 is held by the magnet lever 6. The switch lever 2 assumes a rotational position shown in FIG. 6*a* due to its own weight when the ice level in the ice storage chamber is lower than an installation height of the ice storage detection switch and no force is applied from the blocks of the ice to the switch lever 2. In this case, the magnet 7 held by the magnet lever 6 is disposed in close vicinity of the reed switch 5, which is ON.

When the ice level in the ice storage chamber rises approximately up to the installation height of the ice storage detection switch as the production of the ice by the ice making portion progresses, the switch lever 2 is pressed by the blocks of the ice and its rotational position gradually shifts toward the switch case 1 as shown in FIGS. 6*b* to 6*d*. In accordance with the shift of the rotational position of the switch lever 2, the magnet lever 6 comes into abutment with a corner portion of the reed switch holding portion 4 and rotates, so the magnet 7 held by the magnet lever 6 separates from the reed switch 5. The reed switch 5 is turned OFF as a result of a change in a clearance between the reed switch 5 and the magnet 7 at this moment, and outputs an ice storage detection signal. Based on this ice storage detection signal, the operation of the ice making machine is stopped.

In the conventional ice storage detection switch shown in FIG. 6*a*, however, the magnet lever 6 comes into abutment with the corner portion of the reed switch holding portion 4 to thereby rotate, the amount of change in the clearance between the reed switch 5 and the magnet 7 at the time when the switch lever 2 is pressed toward the switch case 1 is small. When variation of sensitivity exists across the reed switch 5, there is a fear in that the ON/OFF operation may not be performed accurately. For instance, the operational reliability of the ice making machine deteriorates if the reed switch 5 is not turned OFF even when the switch lever 2 is pressed to the extent of coming into abutment with the switch case 1 as shown in FIG. 6*d*, or if the reed switch 5 is not turned ON even when the switch lever 2 has returned to its unpressed state as shown in FIG. 6*a*.

SUMMARY OF THE INVENTION

The present invention has been made to eliminate such problems. Therefore, it is an object of the present invention to provide an ice storage detection switch capable of performing an ON/OFF operation accurately in accordance with an ice level.

According to the present invention, there is provided an ice storage detection switch for detecting an ice level in an ice storage chamber of an ice making machine, the ice storage detection switch comprising: a switch case equipped with a reed switch and fixed in the ice storage chamber of the ice making machine; a switch lever having a magnet and movably fitted to the switch case; a magnet lever rotatably fitted to the switch lever, for holding a magnet so that the magnet is located in a vicinity of the reed switch when the switch lever is not pressed; and a projecting portion formed on the switch case to be located between a rotational center of the magnet lever and the reed switch, the ice level in the ice storage chamber being detected in accordance with a change in a clearance between the reed switch and the magnet, the magnet separating from the reed switch through abutment of the magnet lever on the projecting portion and rotation of the magnet lever when the switch lever is pressed by ice in the ice storage chamber.

DETAILED DESCRIPTION OF THE PREFERRED EMBODIMENTS

Embodiments of the present invention will be described hereinafter with reference to the accompanying drawings.

First Embodiment

Figure 1:
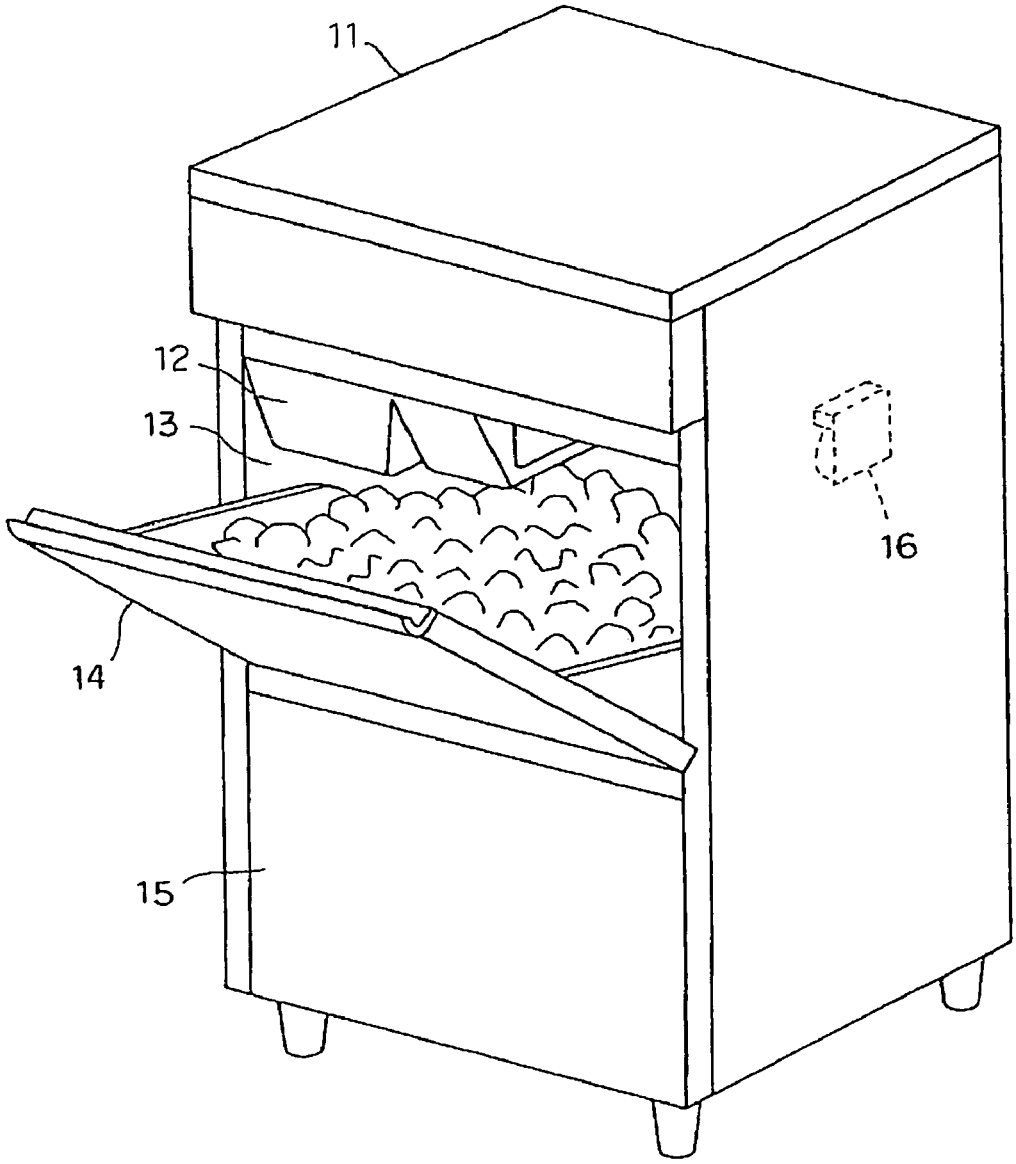
FIG. 1 is a perspective view showing an ice making machine fitted with an ice storage detection switch according to a first embodiment of the present invention.

FIG. 1 shows an ice making machine fitted with an ice storage detection switch according to the first embodiment of the present invention. An ice making portion 12 is disposed in an upper portion of an ice making machine body 11 in the shape of a rectangular parallelepiped, and an ice storage chamber 13 is formed below the ice making portion 12. An opening/closing door 14 is provided in front of the ice storage chamber 13, and the blocks of the ice in the ice storage chamber 13 can be taken out by opening the opening/closing door 14. A machinery chamber 15 in which a compressor forming a refrigeration circuit and the like are accommodated is disposed below the ice storage chamber 13.

The blocks of the ice produced in the ice making portion 12 are sequentially stored in the ice storage chamber 13. An ice storage detection switch 16 is fitted on an inner wall surface of the ice storage chamber 13. When the ice level in the ice storage chamber 13 rises to reach the ice storage detection switch 16, an ice storage detection signal is outputted from the ice storage detection switch 16 to stop an ice making operation.

Figure 2A:
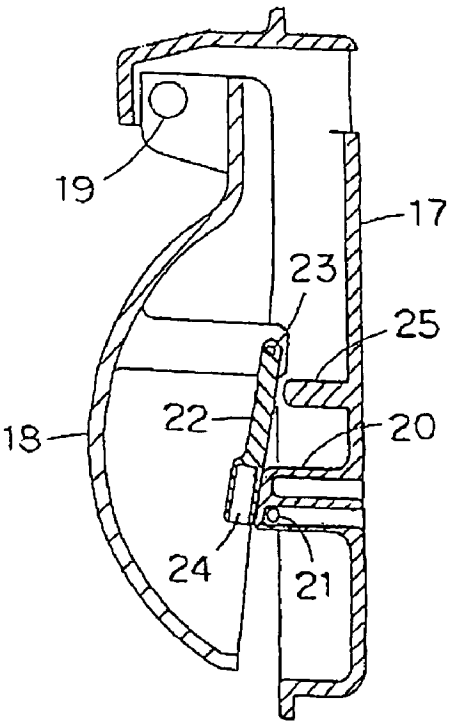
FIGS. 2*a* to 2*d* are sectional views of the ice storage detection switch according to the first embodiment of the present invention showing successive stages of the operation at the time when a switch lever is pressed.

In the ice storage detection switch 16, as shown in FIG. 2*a*, a switch lever 18 is fitted to a switch case 17 fixed to the inner wall surface of the ice storage chamber 13 so that the switch lever 18 can rotate about a rotational center 19. A reed switch holding portion 20 is so formed on the switch case 17 as to protrude toward the switch lever 18, and a reed switch 21 is embedded in the reed switch holding portion 20. A magnet lever 22 is disposed on a back surface side of the switch lever 18, that is, on the switch case 17 side. The magnet lever 22 is fitted at one end thereof to a rotational center 23 so as to be rotatable thereabout, and holds at the other end thereof a magnet 24. Furthermore, a rib 25 as a projecting portion of the present invention is protrusively formed on the switch case 17 between the reed switch holding portion 20 and the rotational center 23 of the magnet lever 22 of the switch lever 18.

Next, an operation of the ice storage detection switch 16 according to the first embodiment of the present invention will be described. When the ice level in the ice storage chamber 13 is lower than an installation height of the ice storage detection switch 16 and no external force is applied horizontally from the blocks of the ice to the switch lever 18, the switch lever 18 assumes a rotational position shown in FIG. 2*a* due to its own weight. At this moment, the other end of the magnet lever 22 abuts on the reed switch holding portion 20 of the switch case 17, and the magnet 24 held by the magnet lever 22 is disposed in the close vicinity of the reed switch 21, which is ON. At this moment, the magnet lever 22 does not abut on a tip portion of the rib 25, and there is formed a clearance between the magnet lever 22 and the rib 25.

Figure 2B:
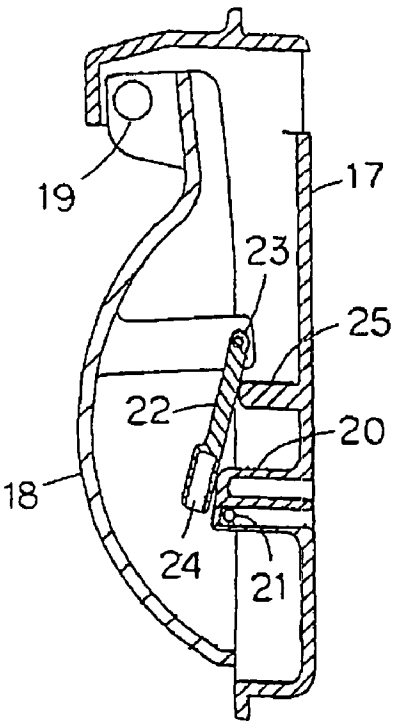
Figure 2C:
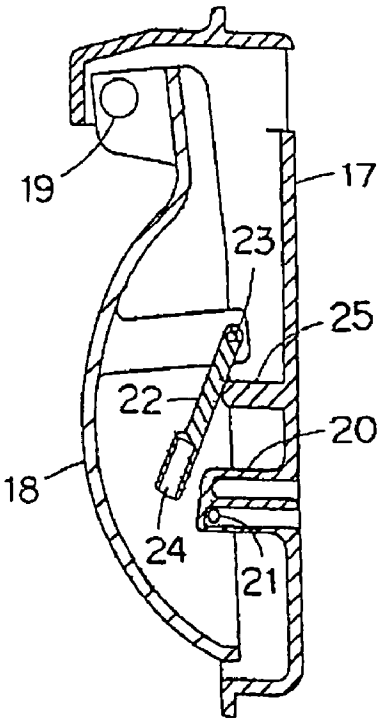

When the ice level in the ice storage chamber 13 rises up to the installation height of the ice storage detection switch 16 as the production of the ice by the ice making portion 12 progresses, the switch lever 18 is pressed by the blocks of the ice to start rotating about the rotational center 19 toward the switch case 17 side. At this moment, the magnet lever 22 is rotatably fitted at one end thereof to the switch lever 18, so the switch lever 18 rotates while the other end of the magnet lever 22 remains in abutment with the reed switch holding portion 20 of the switch case 17. However, after a middle portion of the magnet lever 22 has come into abutment with the tip portion of the rib 25 as shown in FIG. 2*b*, the other end of the magnet lever 22 separates from the reed switch holding portion 20 as shown in FIG. 2*c*, and the switch lever 18 rotates while the middle portion of the magnet lever 22 remains in abutment with the tip portion of the rib 25.

Figure 2D:
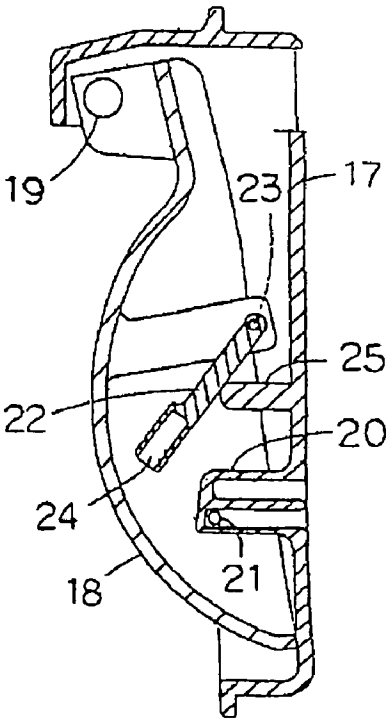

As described above, one end of the magnet lever 22 moves toward the switch case 17 side together with the switch lever 18 while the middle portion of the magnet lever 22 remains in abutment with the tip portion of the rib 25, so the magnet 24 held at the other end of the magnet lever 22 quickly separates from the reed switch 21. Then, the switch 18 finishes its rotational operation when an end 18*a* of the switch lever 18 abuts on an inner surface of the switch case 17 as shown in FIG. 2*d*. At this moment, the clearance between the reed switch 21 and the magnet 24 becomes maximum.

Due to a change in the clearance between the reed switch 21 and the magnet 24 resulting from the rotational operation of the switch lever 18, the reed switch 21 is turned OFF and outputs an ice storage detection signal. Based on this ice storage detection signal, ice making operation of the ice making machine is stopped. After that, when the ice level in the ice storage chamber 13 lowers and the ice storage detection signal from the reed switch 21 is canceled by opening the opening/closing door 14 and consuming the blocks of the ice in the ice storage chamber 13, ice making operation starts again.

Figure 3:
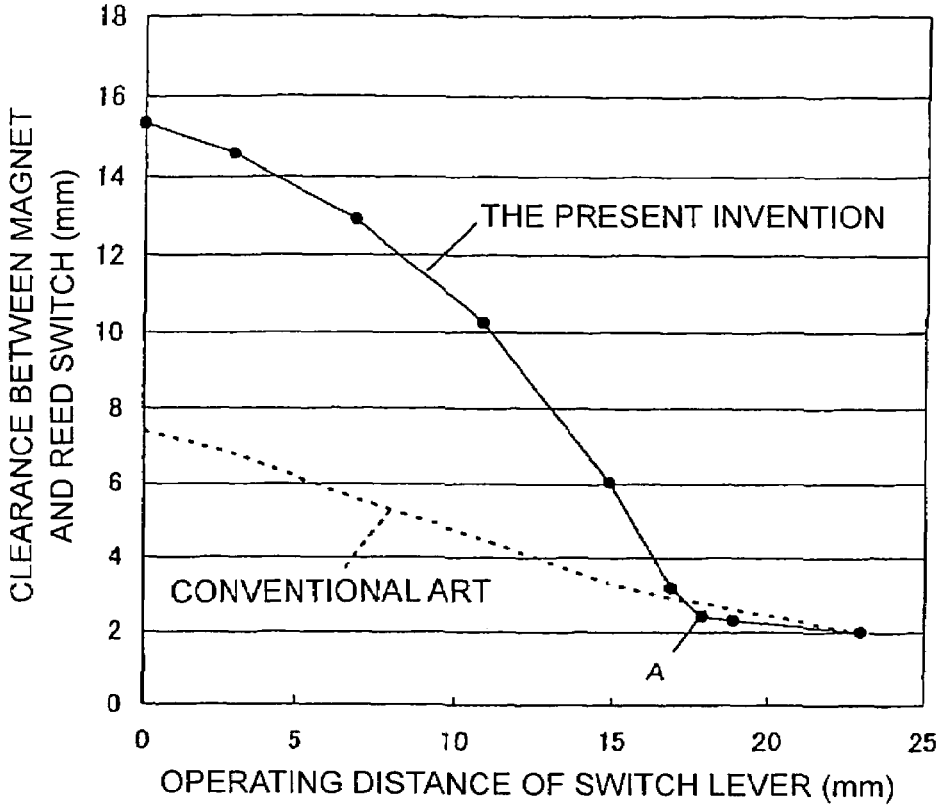
FIG. 3 is a graph showing a change in a clearance between a reed switch and a magnet with respect to an operating distance of the switch lever.

Here, the distance from the inner surface of the switch case 17 to the end 18*a* of the switch lever 18 is defined as an operating distance of the switch lever 18. FIG. 3 shows a result obtained by measuring changes in the clearance between the reed switch 21 and the magnet 24 with respect to the operating distance. For comparison, a measurement result of the ice storage detection switch of the conventional structure is also indicated by a broken line. In the ice storage detection switch 16 according to the first embodiment of the present invention, it is apparent that the clearance between the reed switch 21 and the magnet 24 quickly increases after the switch lever 18 has started rotating and, as shown in FIG. 2*b*, passed a point A where the middle portion of the magnet lever 22 abuts on the tip portion of the rib 25.

Thus, the operation of turning the reed switch 21 ON/OFF is reliably performed in accordance with the rotational operation of the switch lever 18 even when the variation of sensitivity exists across the reed switch 21. That is, the reed switch 21 is reliably turned ON when the switch lever 18 is not pressed as shown in FIG. 2*a*, and the reed switch 21 is reliably turned OFF when the end 18*a* of the switch lever 18 is pressed to the extent of abutting on the inner surface of the switch case 17. As a result, the operational reliability of the ice making machine is enhanced.

Second Embodiment

Figure 4A:
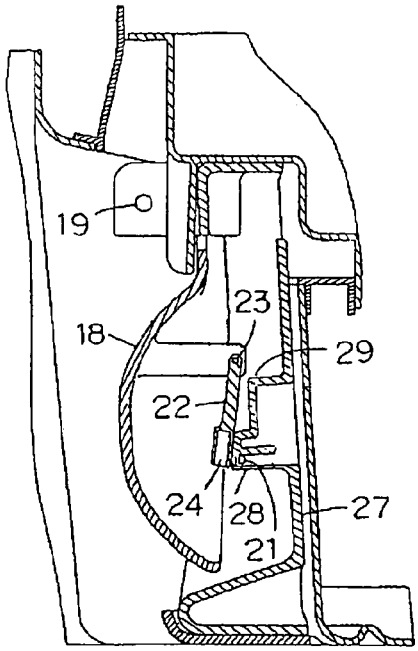
FIGS. 4*a* to 4*d* are sectional views of an ice storage detection switch according to a second embodiment of the present invention showing successive stages of the operation at the time when a switch lever is pressed.

FIG. 4*a* shows an ice storage detection switch according to the second embodiment of the present invention. This ice storage detection switch is composed of, instead of the switch case 17 of the ice storage detection switch 16 according to the first embodiment shown in FIG. 2, a switch case 27 fixed to a lateral wall of the ice storage chamber 13 in such a manner as to be inclined toward an interior thereof, and is substantially identical in other structural details to the ice storage detection switch 16 of the first embodiment of the present invention. That is, the switch lever 18 is fitted to the switch case 27 so as to be rotatable about the rotational center 19, and a reed switch holding portion 28, in which the reed switch 21 is embedded, is so formed on the switch case 27 as to protrude toward the switch lever 18. The magnet lever 22, which is fitted at one end thereof to the rotational center 23 so as to be rotatable thereabout and holds at the other end thereof the magnet 24, is disposed on the back surface side of the switch lever 18. In addition, a projecting portion 29 is protrusively formed on the switch case 27 between the reed switch holding portion 28 and the rotational center 23 of the magnet lever 22 of the switch lever 18.

As shown in FIG. 4*a*, the inclination angle of the forward-inclined switch case 27 is set such that a lower end of the switch lever 18 separates from the switch case 27 due to its own weight when the switch lever 18 is not pressed by any block of ice. At this moment, the other end of the magnet lever 22 abuts on the reed switch holding portion 28 of the switch case 27, and the magnet 24 held by the magnet lever 22 is disposed in the close vicinity of the reed switch 21, which is ON.

Figure 4B:
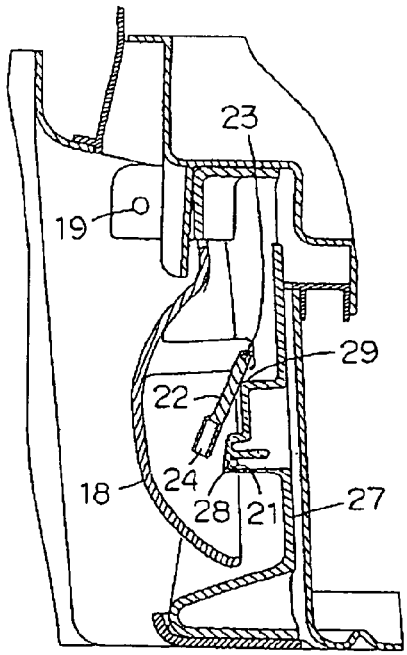
Figure 4C:
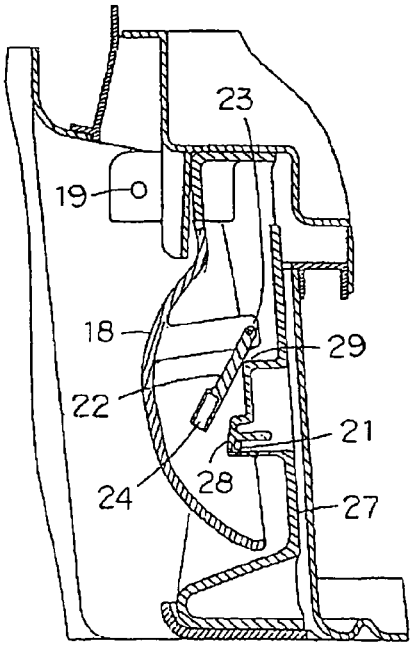

When the ice level in the ice storage chamber 13 rises as the production of the ice by the ice making portion 12 progresses and the switch lever 18 is pressed by the blocks of the ice, the switch lever 18 starts its rotational operation about the rotational center 19 toward the switch case 27 side. After the middle portion of the magnet lever 22 has come into abutment with the projecting portion 29 of the switch case 27 as shown in FIG. 4*b*, the other end of the magnet lever 22 separates from the reed switch holding portion 28 as shown in FIG. 4*c*, so the reed switch 21 is turned OFF.

Figure 4D:
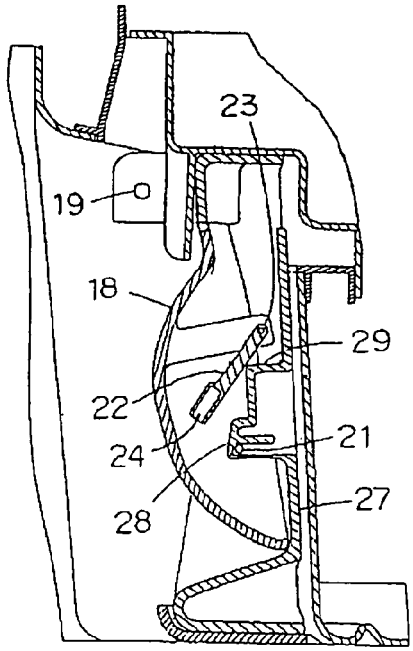
Figure 5:
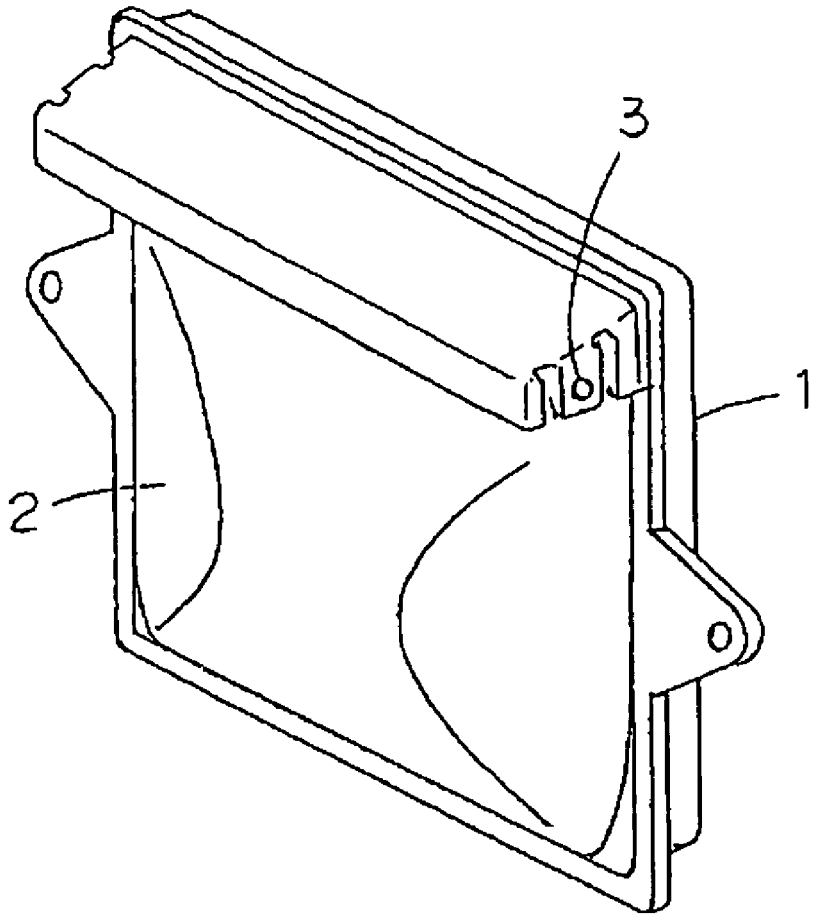
FIG. 5 is a perspective view showing a conventional ice storage detection switch.
Figure 6D:
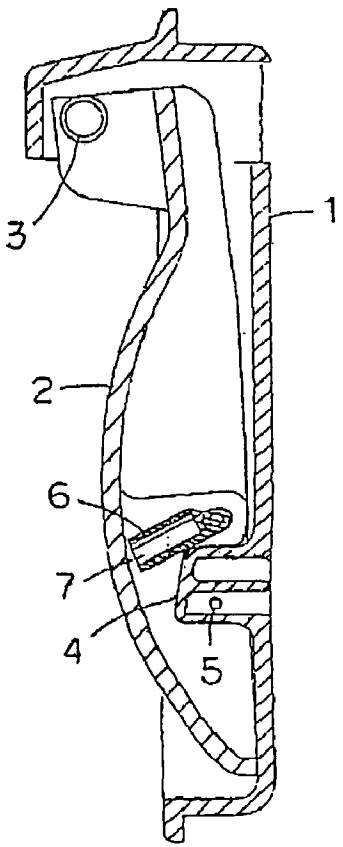
FIGS. 6*a* to 6*d* are sectional views of the conventional ice storage detection switch showing successive stages of the operation at the time when a switch lever is pressed.
Figure 6C:
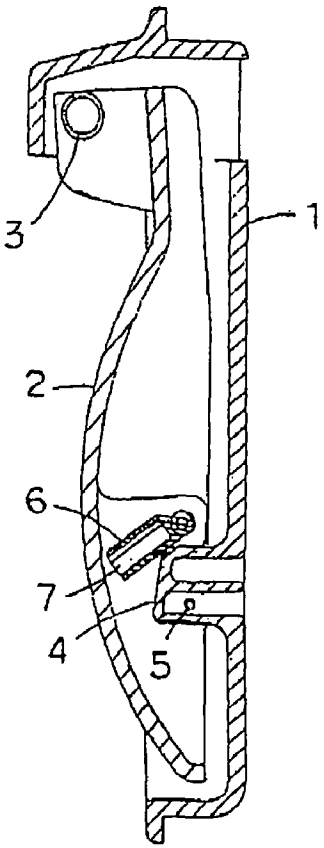
Figure 6B:
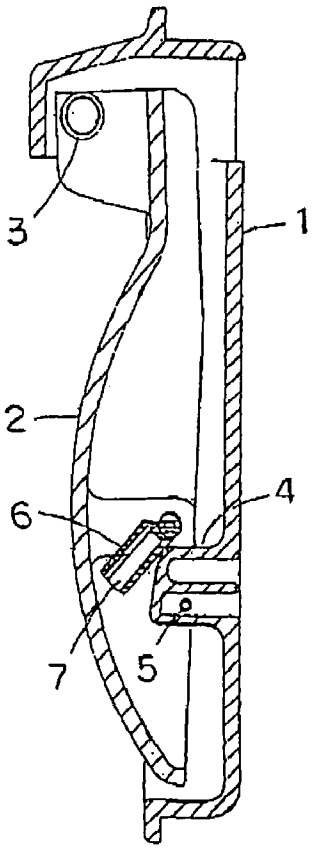
Figure 6A:
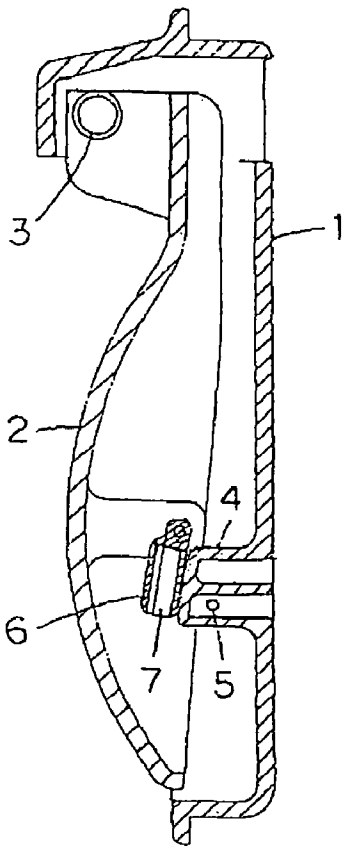

Since one end of the magnet lever 22 moves toward the switch case 27 side together with the switch lever 18 while the middle portion of the magnet lever 22 abuts on the projecting portion 29, the magnet 24 held by the other end of the magnet lever 22 quickly separates from the reed switch 21. When the end 18*a* of the switch lever 18 abuts on an inner surface of the switch case 27 as shown in FIG. 4*d*, the switch lever 18 finishes its rotational operation.

As is the case with the first embodiment of the present invention, the ice making operation of the ice making machine is performed/stopped when the reed switch 21 is ON/OFF, respectively.

According to the ice storage detection switch of the second embodiment of the present invention, the force required for pressing the switch lever 18 toward the switch case 27 side is only for the own weight of the switch lever 18, so the ice level can be reliably detected even when the weight of the blocks of the ice is light.

As described above, according to the present invention, the projecting portion is formed between the rotational center of the magnet lever and the reed switch, and the magnet lever abuts on the projecting portion to rotate when the switch lever is pressed, thereby allowing the magnet to separate from the reed switch. Therefore, the clearance between the reed switch and the magnet is increased, thereby making it possible to perform the ON/OFF operation accurately in accordance with the ice level.

What is claimed is:

1. An ice storage detection switch for detecting an ice level in an ice storage chamber of an ice making machine, the ice storage detection switch comprising:

a switch case equipped with a reed switch and fixed in the ice storage chamber of the ice making machine;

a switch lever having a magnet and movably fitted to the switch case;

a magnet lever rotatably fitted to the switch lever, for holding a magnet so that the magnet is located in a vicinity of the reed switch when the switch lever is not pressed; and a projecting portion formed on the switch case to be located between a rotational center of the magnet lever and the reed switch, the ice level in the ice storage chamber being detected in accordance with a change in a clearance between the reed switch and the magnet, the magnet separating from the reed switch through abutment of the magnet lever on the projecting portion and rotation of the magnet lever when the switch lever is pressed by ice in the ice storage chamber.

2. An ice storage detection switch according to claim 1, wherein:

the switch lever is rotatably fitted at an upper end of the switch lever to the switch case; and the switch case is fixed to a lateral wall in the ice storage chamber at such an inclination angle that a lower end of the switch lever separates from the switch case due to the own weight of the switch lever when the switch lever is not pressed by ice.

3. An ice storage detection switch according to claim 1, wherein:

the magnet lever rotates around one end thereof and holds the magnet at the other end thereof, the middle portion of the magnet lever abutting on the projecting portion.

* * * * *